United States Patent [19]

Wertz, Jr.

[11] Patent Number: 4,722,207

[45] Date of Patent: Feb. 2, 1988

[54] SECURITY SYSTEMS

[75] Inventor: Leonard R. Wertz, Jr., Monmouth County, N.J.

[73] Assignee: Art Metal U.S.A., Inc., Newark, N.J.

[21] Appl. No.: 848,039

[22] Filed: Apr. 4, 1986

Related U.S. Application Data

[63] Continuation-in-part of Ser. No. 842,141, Mar. 21, 1986, Pat. No. 4,693,100.

[51] Int. Cl.[4] ..... E05B 37/08

[52] U.S. Cl. ..... 70/303 A; 70/316; 70/323; 70/333 R

[58] Field of Search ..... 70/302, 303 R, 303 A, 70/315, 316, 317, 318, 323, 325, 333 R

[56] References Cited

U.S. PATENT DOCUMENTS

| | | | |
|---|---|---|---|
| 2,016,487 | 10/1935 | Doenges | 70/323 |
| 3,045,466 | 7/1962 | Aerlong | 70/303 A |
| 3,386,275 | 6/1968 | Potzick . | |
| 3,906,761 | 9/1975 | Swaim . | |
| 3,968,667 | 7/1976 | Gartner et al. . | |
| 3,983,727 | 10/1976 | Todd . | |
| 4,040,280 | 8/1977 | Main | 70/333 R |
| 4,142,388 | 3/1979 | Phillips et al. . | |
| 4,257,249 | 3/1981 | Johns-Hunt . | |
| 4,275,576 | 6/1981 | Miller . | |
| 4,353,231 | 10/1982 | Uyeda . | |
| 4,420,955 | 12/1983 | Marold . | |
| 4,532,785 | 8/1985 | Uyeda . | |
| 4,541,259 | 9/1985 | Uyeda . | |

*Primary Examiner*—Robert L. Wolfe

*Attorney, Agent, or Firm*—Dickstein, Shapiro & Morin

[57] ABSTRACT

A security system having a secure enclosure for holding an object. Access to the enclosure is controlled by a combination lock having a tumbler arrangement adapted for having its combination changed either by hand or with use of a key. The tumbler arrangement includes an apparatus for mounting a plurality of tumbler wheels in a stacked relationship for rotation about an axis. Each of the tumbler wheels has an inner element releasably engaged with a circumferentially disposed outer element. Each of the outer elements has a peripheral gate and a mechanism for masking the gate. A mechanism is provided for maintaining the inner and outer elements in an engaged condition for simultaneous rotation under normal tumber operation, and a peripherally gated rotatable driver wheel rotates the tumbler wheels. A fence lever includes a nose for contact with the driver wheel and a fence for contact with the tumbler wheels. The tumbler arrangement also includes an apparatus for preventing contact by the fence with the circumferential edges of the tumbler wheels while the tumbler wheels are being rotated. Finally, a mechanism is provided for axially disengaging the stacked inner elements from the stacked outer elements by the key while simultaneously preventing rotational and axial movement of the outer elements as the disengaged inner elements are rotated to change the combination of the tumbler arrangement in the combination lock.

28 Claims, 27 Drawing Figures

SECURITY SYSTEMS

This application is a continuation-in-part of U.S. Ser. No. 842,141, filed Mar. 21, 1986, now U.S. Pat. No. 4,693,100.

BACKGROUND OF THE PRESENT INVENTION

1. Field of the Invention

The present invention relates to security system locks and, more particularly, to high security combination locks and cabinets, safes, vaults, doors and doors employing such locks.

2. Description of the Prior Art

Conventional security system combination locks generally include certain basic components. Such locks usually include three or four stacked tumbler wheels which are coaxially mounted for rotation about a post disposed within a lock casing. The lock dial, which usually has a plurality of calibration marks such as the numbers 1 to 100 thereon, is connected to a spindle which extends into the lock case. A drive wheel is generally provided in a coaxial relationship with the tumbler wheels for driving the tumbler wheels, drive wheel itself being driven by rotation of the lock dial.

A drive pin typically projects from the drive wheel and, conventional fly rotatable through a limited arc associated with the endmost tumbler wheel, provides a lost motion coupling to drive the endmost tumbler heel a predetermined relationship to the drive wheel. A similar lost motion coupling is generally provided between each of the successive tumbler wheels so that each of the tumbler wheels may be driven upon predetermined rotation of the drive wheel. Generally, the lost motion coupling between each of the successive tumbler wheels and between the endmost tumbler wheel and the drive wheel includes a fly having a ring portion journaled in concentric relation with its associated tumbler wheel and the ring portion having a radial projection which lies between a pair of stop shoulders formed in the tumbler wheel and disposed to limit angular rotation of the fly to a desired lost motion range, such as about 20°. A drive pin or lug projects from the adjacent tumbler wheel to engage the fly and thus engage the stop shoulders of the first mentioned tumbler wheel provided the fly has moved through its predetermined lost motion angular range. Each of the tumbler wheels and the drive wheel is provided with a peripheral notch or gate at a selected radial position along the circumferential edge thereof.

A fence lever is generally pivotally connected near one end to a reciprocating bolt slidably supported in the lock casing. The fence Lever is frequently provided with a depending nose portion near the opposite or free end thereof which, in conventional combination locks, is designed to ride upon the drive wheel periphery. This nose portion usually includes a fence projecting laterally from the fence lever in overlaying relation to the peripheries of the tumbler wheels. The position of the fence in relation to the length of the fence lever nose is usually such that the fence is spaced slightly outwardly from the peripheries of the tumbler wheels when the fence lever nose is riding on the drive wheel periphery.

In the case of such conventional combination lock mechanisms, the combination lock is opened by rotation of the dial in a predetermined sequence of clockwise and counterclockwise direction through predetermined numbers of revolutions to a series of numerical positions indicated by alignment of the calibration marks on the lock dial with a fixed index. Such dialing of a predetermined series of combination numbers effects angular rotation of the plurality of tumbler wheels. This results in the alignment of the tumbler wheel peripheral gates with the fence. The dial is then rotated to bring the drive wheel gate to a position registered with the fence lever nose to cause the fence lever nose and fence to drop into the aligned gates whereupon further rotation of the dial through a partial revolution in a predetermined direction achieves retraction of the lock bolt.

During normal use of such combination locks, and in particular high security locks, it becomes necessary to change the lock combination at various times. In fact, it is standard operating procedure in many areas of business and government to change the lock combination at frequent intervals for security reason, even as often as once a day. Changes in personnel and possible unauthorized access to the combination, among other reasons, dictate such changes to the lock combination.

In conventional combination locks utilizing such rotatable tumblers as described above, the lock combination is frequently changed by hand. This requires opening the lock case, taking the tumbler mechanism apart, resetting angular position of each tumbler gate with respect to the dial, reassembling the tumblers, and replacing them in the lock case. This mode of changing the combination oftentimes requires the efforts of a locksmith and, at the very least, requires a fairly extensive amount of work for each combination change. Moreover, the loss of a small part or the mishandling of component portions can cause further difficulties. On the other hand, this type of lock combination changing mode permits the maximum number of possible lock combinations to be selected.

Combination locks which include tumblers having externally actuated mechanisms for effecting the resetting of the combination through means of a special tool or key have also been provided in the past. U.S. Pat. No. 3,386,275 is one example of such a mechanism. Such key changeable tumbler mechanisms are usually actuated by a key which is inserted through an aperture provided in the rear wall of the lock case. The key uncouples an outer tumbler gate portion from an inner tumbler portion, thereby permitting the angular position of the dial relative to one or more of the tumbler gate portions to be changed without disassembling the lock.

While such key changeable tumblers do afford convenience to the operator, they have frequently been lacking in many other respects. In particular, key changeable tumbler constructions have been subject to attack by radiographic means whereby the tumbler gate positions can sometimes be determined through X-ray photographs of the lock taken through the safe or file. Other proposed constructions have not afforded sufficiently positive mechanisms for determining or holding the preselected position of the various adjustable tumbler portion with the result that undesirable relative movement of the tumbler gates sometimes occurs. This makes these constructions more readily subject to unauthorized external access.

Prior combination locks have also been provided with various types of mechanisms mounted on the drive wheel to resist detection of the "feel" of the points of engagement of the fence lever nose with the driving wheel gate in accordance with well-known lock manipulation procedures. One such example is U.S. Pat. No.

3,968,667 wherein the fence lever is maintained away from the driver wheel and tumblers by a spring loading mechanism. Frequently, however, such mechanisms have complicated the construction of the locks as well as been only partially effective in shielding the lock mechanism from external detection.

SUMMARY OF THE INVENTION

Accordingly, it is one object of the present invention to provide a combination lock having a tumbler arrangement which permits changing of the lock combination either manually in a simple way or with the use of a key which permits a wide selection of different possible lock combinations.

It is another object of the present invention to provide a security system in a cabinet, vault, safe, door or otherwise having a combination lock having improved security to prevent detection of the combination through external means.

It a further object of the present invention to provide a combination lock mechanism having a tumbler arrangement with an improved tumbler wheel gate masking feature particularly useful against radiographic techniques.

It is still another object of the present invention to provide a combination lock having a tumbler arrangement with an improved mechanism to prevent detection of the lock combination by manipulation of the lock dial and the sensing of the contact of the gates with the fence lever to determine the radial positions of the gates.

To achieve the foregoing and other objects and in accordance with the purpose of the invention, a tumbler arrangement is provided for a combination lock and is adapted for having its combination changed either by hand or with the use of a key. The tumbler arrangement includes a mechanism for mounting a plurality of tumbler wheels in a stacked relationship for rotation about an axis. Each of the tumbler wheels has an inner element releasably engaged with a circumferentially disposed outer element. Each of the outer elements has a peripheral gate and a mechanism for masking the gate. A mechanism is provided for maintaining the inner and outer elements in an engaged condition for simultaneous rotation under normal tumbler operation, and a peripherally gated rotatable driver wheel rotates the tumbler wheels. A fence lever includes a nose for contact with the driver wheel and a fence for contact with the tumbler wheels. The tumbler arrangement further includes an apparatus for preventing contact by the fence with the circumferential edges of the tumbler wheels when the tumbler wheels are being rotated. Finally, an apparatus is provided for axially disengaging the stacked inner elements from the stacked outer elements by the key while simultaneously preventing rotational a axial movement of the outer elements as the disengaged inner elements are rotated to change the combination of the tumbler arrangement in the combination lock.

BRIEF DESCRIPTION OF THE DRAWINGS

The features of the present invention which are believed to be novel are set forth with particularly in the appended claims. The invention, together with further objects and attendant advantages thereof, may best be understood by reference to the following description taken in conjunction with the accompanying drawings and in which:

DETAILED DESCRIPTION OF THE PREFERRED EMBODIMENTS

Figure 1:
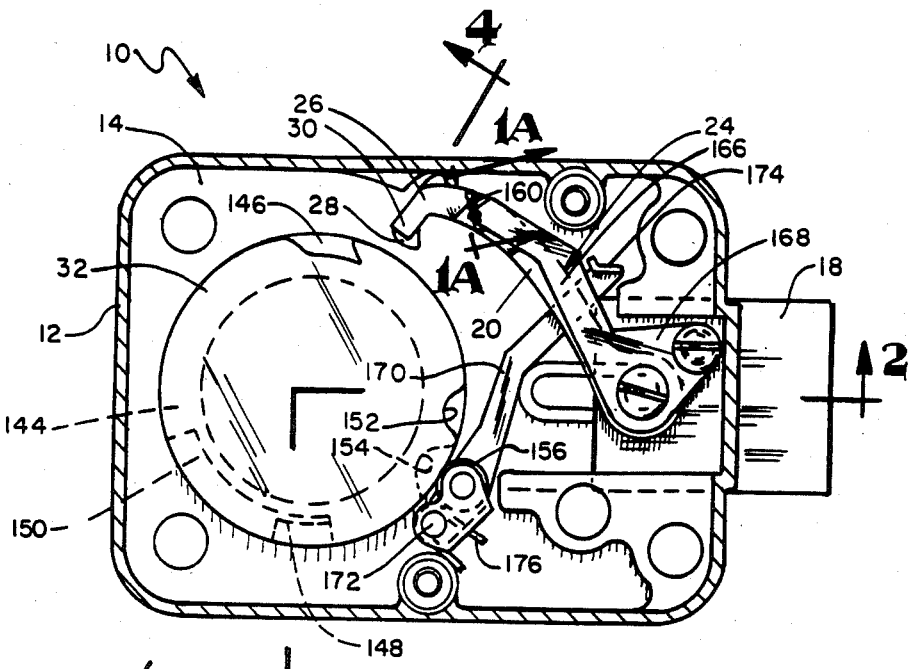
FIG 1 is a rear view of one embodiment of a combination lock with the rear wall of the lock case and the tumblers removed therefrom.
Figure 2:
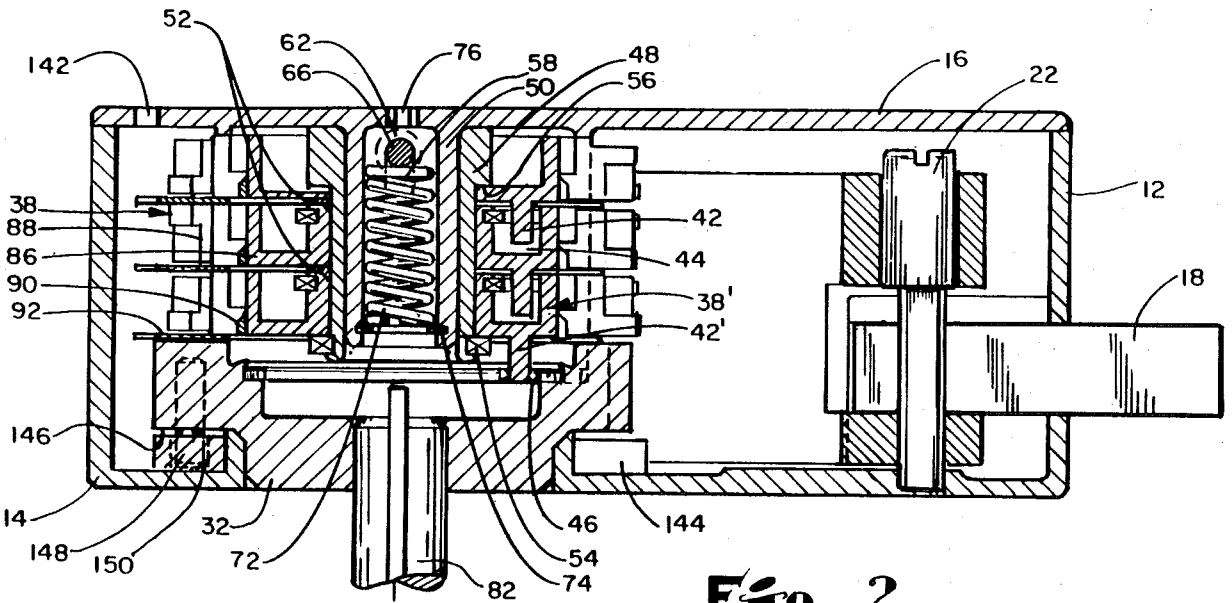
FIG. 2 is a cross-sectional view taken substantially along line 2—2 of FIG. 1 but with all the lock components in position and illustrating the lock assembly thereof in normal operational condition.

Referring to the figures and in particular to FIG. 1, a combination lock assembly 10 is provided having a lock case 12 with a front wall 14 and a rear wall 16 (FIG. 2). In the preferred embodiment, the rear wall 16 is removably secured to the case 12 so that the interior components of the combination lock 10 may be readily accessible.

Figure 16:
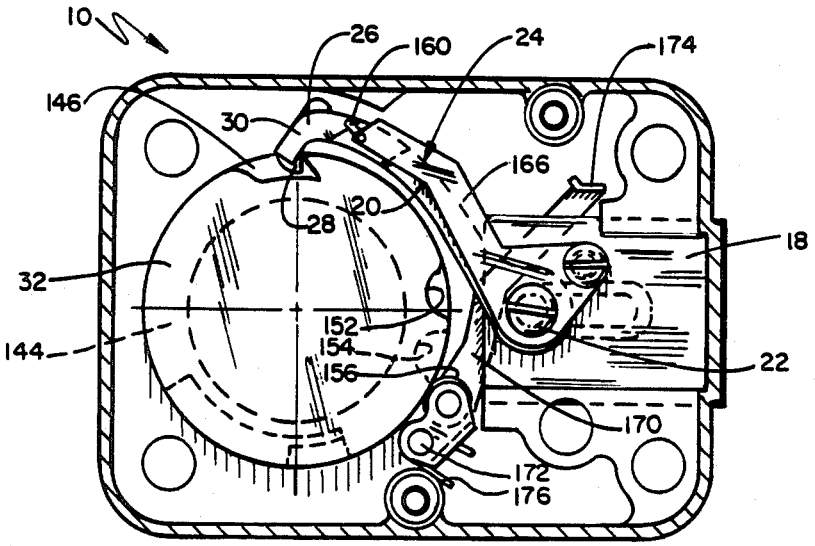
FIG. 16 is a view similar to FIG. 15 showing the lock bolt withdrawn to its unlocked position.

The lock 10 also includes a lock bolt 18 which is movable between a locked position as illustrated in FIGS. 1 and 2 and an unlocked position as illustrated in FIG. 16 wherein the bolt 18 is retracted into the case 12. A fence lever 20 is pivotally connected to the bolt 18 by a pivot pin 22 and is adapted to move the bolt 18 between its locked and unlocked positions. A spring mechanism 24 is provided for holding the fence lever 20 away from as well as against the driver and tumbler wheels as described in greater detail below. The free end 26 of the fence lever 20 includes a depending nose portion 28 and a fence portion 30 designed to engage the gates, respectively, in the driver wheel and the tumbler wheel assembly of the present invention also as described below.

Figure 3:
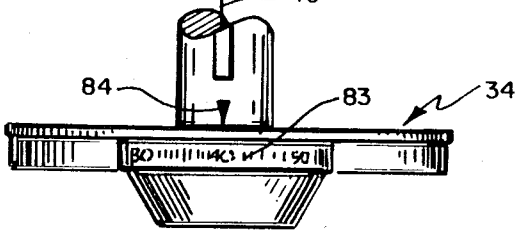
FIG. 3 is a plan view of a dial assembly which may be used in conjunction with the combination lock illustrated in FIGS. 1 and 2.
Figure 10:
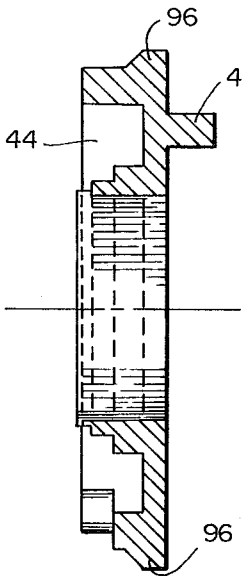
FIG. 10 is a cross-sectional view taken substantially along line 10—10 of FIG. 9.
Figure 11:
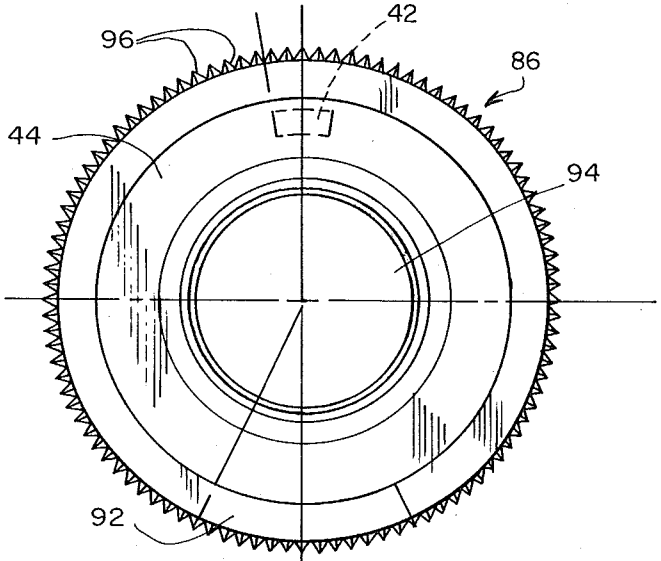
FIG. 11 is a rear schematic view of the inner wheel element of FIG. 9.
Figure 17:
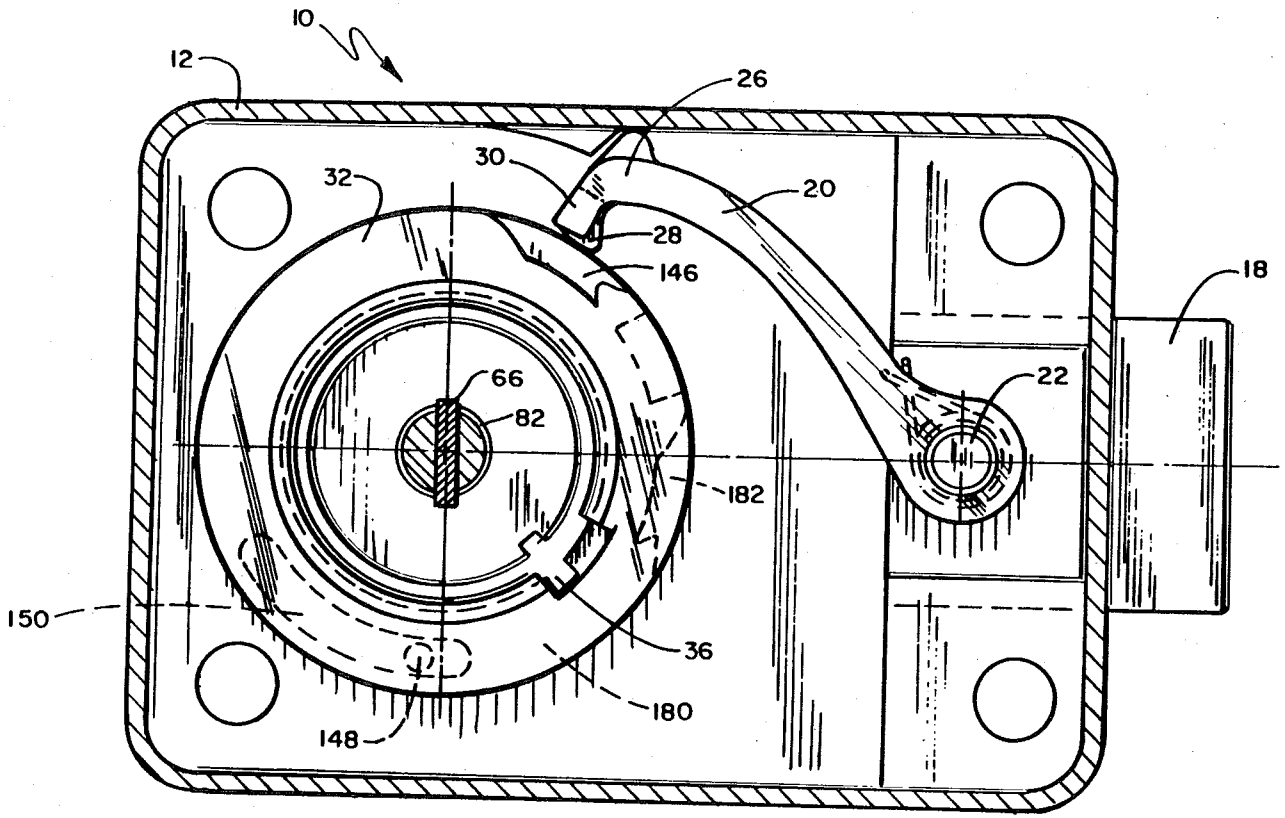
FIG. 17 is a front view of another embodiment of a combination lock with the front wall of the lock case removed therefrom.

Referring more particularly to FIGS. 1 and 2, a driver wheel 32 is secured for rotation to an outer dial 34 (see FIG. 3) and includes a driver fly 36 (see FIG. 17). A plurality, and preferably three, tumbler wheels 38 are coaxially aligned in a stacked relationship along an axis 40. The tumbler wheels 38 are secured for rotation about the axis 40. Each of the tumbler wheels 38 is connected to an adjacent tumbler wheel 38 through a lost motion slot arrangement. More specifically, each tumbler wheel 38 includes (see FIG. 10 also) a pin 42 projecting from the forward face thereof for engagement within a lost motion slot 44 of the adjacent tumbler wheel 38. Similarly, the forward most tumbler wheel has its pin 42' adapted for movement within a lost motion slot 46 located within the driver wheel 32 and for engagement with the driver fly 36. Thus, rotation of the driver wheel 32 engages the pin 42' of the first adjacent tumbler wheel 38' to rotate the tumbler wheel 38'. This motion is likewise translated to rotation of subsequent tumbler wheels 38 within the stack.

The lost motion pins 42 and slots 44 of the tumbler wheels 38 of the subject invention are arranged such that the tumbler wheels 38 will not reverse direction of rotation until the driver wheel 32 has been reversed at least one full revolution.

Referring now to FIGS. 1–4, the tumbler wheels 38 are preferably loosely journaled in a stacked relationship about a tumbler post 48. In preferred form, the tumbler post 48 projects along the axis 40 inwardly into the case 12 from the inner surface of the rear wall 16. The tumbler post 48 is mounted coaxially in a sleeve-like manner about a cylindrical stud 50 which is secured directly to the inner surface of the rear wall 16 and projects normally therefrom. The tumbler post 48 is mounted for limited axial movement along the cylindrical stud 50.

As previously indicated, the tumbler wheels 3B are mounted for rotation about the post 48. Spacers 52 are interposed between adjacent tumbler wheels 38, and the spacers 52 are keyed to the post 48. A retaining ring 54 retains the tumbler wheels 38 about the tumbler post 48 and abutted against an annular shoulder 56 disposed around the post 48.

The cylindrical stud 50 includes a pair of axial slots 58 and 60 disposed in the sides thereof opposite each other and toward the rear wall 16 of the case 12. Apertures 62 and 64 are provided opposite each other in the tumbler post 4B and are aligned with the slots 58, 60. A catch arm 66, preferably in the form of a clevis pin, extends through the slots 58, 60 and the apertures 62, 64 and is secured by the end members 68, 70 to the tumbler post 48 for axial movement therewith. In this manner, the clevis pin 66 may move the length of the slots 58, 60 and thereby afford limited axial movement of the tumbler post 48 along the cylindrical stud 50. The amount of this movement is dependent upon the length of slots 58, 60 formed in the sides of the stud 50.

A helical spring 72 is preferably located within the cylindrical stud 50 and is interposed between the clevis pin 66 and a retaining ring 74 positioned at the front end of stud 50. The spring 72 is in compression and exerts a force against the clevis pin 66 so as to maintain the clevis pin at the rearmost ends of the slots 58, 60 during normal tumbler operation as illustrated in FIG. 2. Spring 72 maybe further compressed when the clevis pin 66 is moved the length of slots 58, 60 by an exterior force thereby moving the tumbler post axially relative to the stud 50.

The clevis pin 66 is preferably cross aligned directly with an aperture 76 located in the rear wall 16 of the case 12. A combination change key assembly 78 preferably includes a key 80 which is insertable through the aperture 76 to engage the clevis pin 66. Once the pin 66 is engaged by the key 80, the key 80 may then be moved further into the case 12 against the force of the spring 72 so as to move pin 66 engaged in apertures 62, 64 of post 48 and thus move the tumbler post 48 in an axial direction relative to the stud 50.

Figure 4:
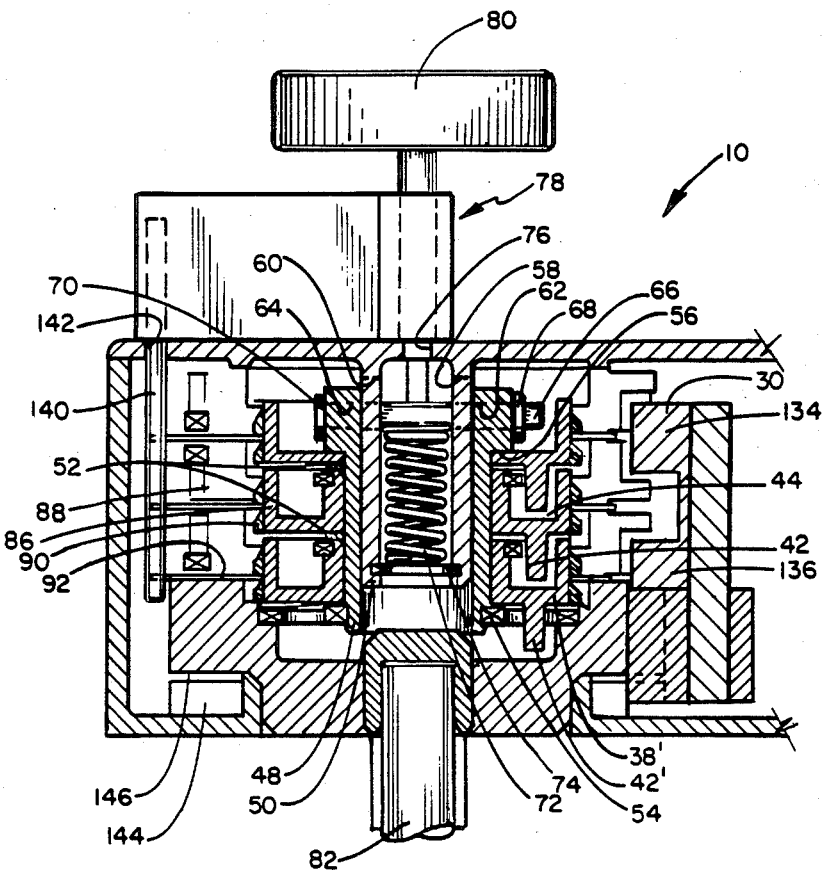
FIG. 4 is a cross-sectional view taken substantially along line 4—4 of FIG. 1 but with all the components in position and illustrating the lock assembly thereof with the key change assembly inserted herein for hanging the combination of the lock.

Key 80 and aperture 76 are shaped such that key 80 may be inserted in aperture 76 and, after moving post 48, may be turned to engage front wall 16 and lock into place. In the embodiment of FIG. 2, aperture 76 is a center hole having two opposed slots extending therefrom. As seen in FIG. 4, key 80 is shaped to insert into aperture 76 and is a shaft with two opposed wings extending therefrom.

When the key 80 is removed from the case 12, the spring 72 returns the tumbler post 48 to its normal operational position on the stud 50. This movement of the post 48 on the stud 50 in response to insertion of the change key assembly into the case 12 is used to change the combination of the lock 10 with the key assembly 78 as further described below.

The driver wheel 32 is normally secured and keyed to the exterior dial 34 by a spindle or dial arbor 82. As particularly seen in FIG. 3, the dial typically has a plurality of numerical calibrations 83 thereon which preferably total to 100. A fixed marking index 84 permits rotation of the numbers on the dial 34 in a predetermined sequence of clockwise and counterclockwise rotational directions through predetermined numbers of revolutions to a series of numerical positions indicated by the numbers and the index 84. This dials a predetermined series of numbers and thereby effects angular rotation of the tumbler wheels 38 to positions which result in alignment of the tumbler wheel peripheral gates, described below, with the fence 30. The dial 34 is then rotated to bring the drive wheel 32 to a position registered with the fence lever nose 28 to cause the fence lever nose 28 and the fence 30 to be biased into the gates as described below whereupon further rotation of the dial 34 through a partial revolution in a predetermined direction achieves retraction of the bolt 18 as seen in FIG. 17.

Referring to FIGS. 3–12, each tumbler wheel 38 includes an inner element or wheel 86 and an outer element or wheel 88. Each inner and outer wheel 86, 88 are releasably interconnected by an engagement mechanism 90. Under normal lock operation as illustrated in FIG. 2, the inner and outer wheels 86, 88 of each tumbler wheel 38 are interconnected so as to revolve around the tumbler post 48 together. When it is desired to change the combination of the lock 10, the tumbler post 48 is moved axially along the cylindrical stud 50. In this instance, the inner wheels 86 accompany the tumbler post 48 in its axial movement due to the retaining ring 54 and the shoulder 56. However, due to the design of the driver wheel 32, the outer wheels 88 abut an inner should 92 of the driver wheel 32 so as to maintain the position of the outer wheels 88. As the tumbler post 48 is moved axially, then, the engagement mechanism 90 disengages so that the inner wheels 86 disconnect from the outer wheels 88. Once the inner wheels 86 are disengaged from the outer wheels 88, the inner wheels 86 may be rotated by the dial 34 so as to set a new combination of any desired numbers. This is, in part, the mechanism used to change the lock combination with the use of the key assembly 78.

If it is desired to change the combination of the lock 10 by hand, the rear wall 16 of the case 12 is removed. Since the cylindrical stud 50 is secured to the rear wall 14, removal of the rear wall 14 also removes the cylindrical stud 50 and the accompanying tumbler post 48 and tumbler wheels 38. Once these members are removed from the case 12, the retaining ring 54 may be readily disconnected. Thereafter, each tumbler wheel 38 is slidingly removed from the tumbler post 48, and the engagement mechanism 90 is disengaged manually. At this time, any desired number may be dialed in by rotating the relative positions of the inner and outer wheels 86, 88 of each tumbler wheel 38. Inner wheel 86 includes indicia 100 about its periphery and outer wheel 88 includes a marker which aligns with the number selected. After each of the tumbler wheels 38 are so changed, the retaining ring 54 is replaced, and the entire assembly is then mounted back into the case 12.

Referring more particularly, now, to FIGS. 5–12, the engaging mechanism 90 of each tumbler wheel 38 preferably includes a pair of teeth positioned on both inner and outer wheels 86, 88 so as to intermesh with each other. Looking first at the inner wheel 86 illustrated in FIGS. 9–12, a wheel member 92 is provided with an axial opening 94 therein. The opening 94 is sized and shaped to receive the tumbler post 48 when the tumbler wheel 38 is mounted thereon. The lost motion pin 42 and slot 44, as previously described, may be seen clearly in FIGS. 9 and 11. Disposed about the outer circumferential edge of the wheel 92 is a first set of a plurality of teeth 96. Preferably, there are as many teeth 96 as there are number calibrations on the dial 34 with each tooth designating a specific numeral. Each tooth 96 preferably has a tapered or beveled rearward end 98 which projects toward the rear wall 16 of the case 12 when the tumbler wheels 38 are journaled about the post 48. The beveled ends 98 aid in engagement and disengagement with the outer wheel 88 as further described below.

In addition, each inner wheel member 92 includes a plurality of numerical indicia 100 along the face thereof. These indicia 100 correspond to the numerical calibrations on the dial 34. the indicia 100 are used when setting the combination of the lock 10 by hand as described above.

Referring more particularly to FIGS. 5–8, each outer wheel 88 includes a collar member 102 which has a central bore 104 sized and shaped to receive the inner wheel 92 therein. Disposed along the inner circumferential edge of the collar 102 is a second set of a plurality of teeth 106 which are sized and shaped to intermesh and interlock with the teeth 96 of the inner wheel member 92. The teeth 106 have their forward ends 108 tapered and beveled so as to assist in intermeshing with the beveled rearward ends 98 of the teeth 96. These are particularly useful when changing the combination of the lock 10 by use of the key 80 wherein the inner wheels 86 are disengaged from the outer wheels 86 by movement of the tumbler post 48 axially along the stud 50. The engagement and disengagement of the teeth 96 and 106 are assisted greatly by the beveled portions 98 and 108 thereof.

An index mark 110 is provided on the front face of the outer collar 102 for alignment with a selected numerical indicia 100 on the forward face of the inner wheel 92. This index mark 110 is used when changing the combination of the lock 10 by hand. However, the index mark 110 will align with the appropriate numerical indicia 100 whenever the combination is set. In order to aid in security of the lock 10 a plurality of false index marks 112 are provided on the rear face of the outer collar 102. In this manner, X-ray detection of the combination lock 10 will show a plurality of index marks along each outer collar 102. However, it is virtually impossible with known X-ray detection equipment or other radiographic techniques to determine which is the real index mark 110 and which are the false marks 112.

As previously indicated, each tumbler wheel 38 includes a peripheral gate 114 wherein the fence 30 drops when all of the gates 114 of the tumbler wheels 38 are aligned for opening of the lock 10. Conventionally, the gate in the tumbler wheel is a notch through the entire thickness of the tumbler wheel so that the fence of the lever may drop into it. Consequently, radiological manipulation may readily indicate gate openings in tumbler wheels as seen in X-ray pictures. If this is the case, then the number of possible combinations for the lock 10 can be reduced to twelve or less which can be tried in a matter of minutes. This would greatly reduce the security of any such lock.

In the present invention, however, the gate 114 is not a notch through the entire thickness of the tumbler wheel 38. Instead, the circumferential edge of the wheel 38 is in the form of a peripheral rim 116 disposed proximate one of the two faces of the outer wheel 88. In FIGS. 5–8, the rim 116 is disposed proximate the rear face 118 of the outer wheel 88. Another embodiment is illustrated in FIGS. 6A–8A which show the rim 116 disposed adjacent the front face 120 of the outer wheel 88. The purpose for the two embodiments will be discussed in detail below.

To form the gate 114, the rim 116 is axially indented parallel to the central axis 122 of the element 88 to form an indentation 124 in the rim. The indentation is formed along the opposite front face 120, thus forming the opening or gate 114. The side portions 126, 128 of the indentation 124 are slanted from the face 118 to the face 120. Moreover, the cross-sectional thickness of the side portions 126 an 128 is less than the cross-sectional thickness of the rest of the rim 116 as represented by the length of the lines 130. This is because the thickness of the sides 126, 128 is adjusted so as to create an "axial cross-sectional thickness" as represented by the length of the line 132 substantially identical to that of the rest of the rim 116, i.e., the length of line 132 equals the length of line 130. "Axial cross-sectional thickness" is defined as the length of a section taken through the sides 126, 128 parallel to the axis 122. Consequently, when the element 88 is viewed radiographically from the front of the lock 10, the rim 116 displays a uniform thickness throughout, thereby masking the location of the gate 114.

As seen more clearly in FIG. 2, the preferred embodiment includes three coaxially aligned tumbler wheels 38 (which includes 38'). The first and third tumbler wheels have their gates 114 disposed proximate their rear faces 118 similar to that illustrated in FIGS. 5–8, while the middle wheel 38 has its gate 114 disposed along its front face 120 similar to FIGS. 6A–8A. Therefore, the gate 114 of the middle wheel 38 will face the gate 114 of its adjacent rear wheel 38. In addition, the fence 30 is segmented into two portions, 134 and 136. The fence portion 134 is the larger of the two and is adapted to fit two adjacent gates 114, while the portion 136 is adapted to fit the remaining single gate 114 of the forward wheel 38'.

Figures 5, 6, 8:
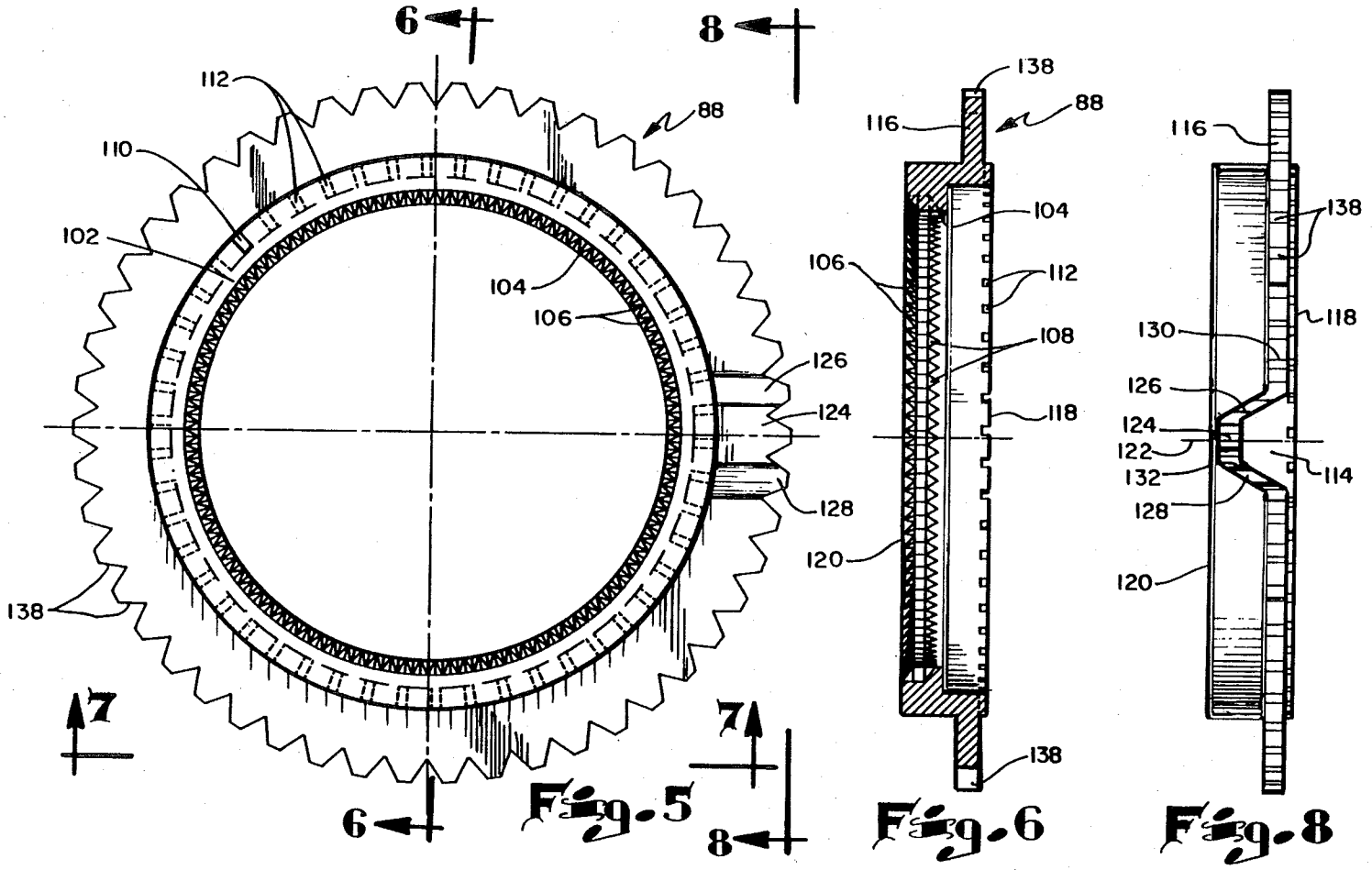
FIG. 5 is an enlarged, front schematic view of an outer wheel element of a tumbler wheel used in one embodiment of the present invention.
FIG. 6 is a cross-sectional view taken substantially along line 6—6 of FIG. 5.
FIG. 8 is another side perspective view of the outer wheel element of FIG. 5 taken substantially along line 8—8 thereof.
Figure 8A:
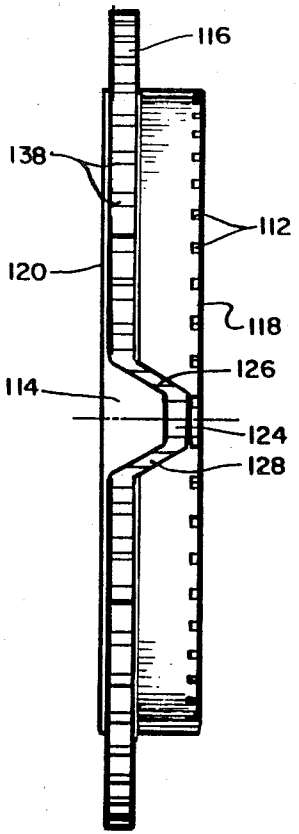
FIG. 8A is a side perspective view similar to that of FIG. B but showing the outer element illustrated in FIG. 6A.
Figure 6A:
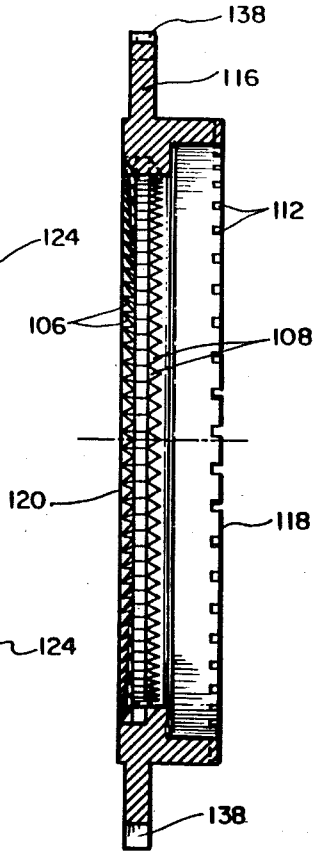
FIG. 6A is a cross-sectional view similar to FIG. 6 but illustrating the outer element having its outermost rim adjacent. the face opposite that illustrated in FIGS. 5 and 6.
Figure 7A:
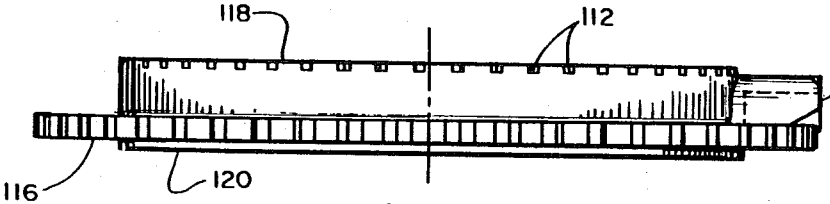
FIG. 7A is a side perspective view similar to that of FIG. 7 but showing the outer element illustrated in FIG. 6A.
Figure 7:
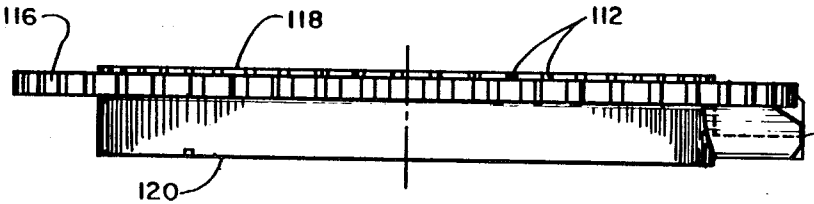
FIG. 7 is a side perspective view of the outer wheel element of FIG. 5 taken substantially along line 7—7 thereof.
Figure 9:
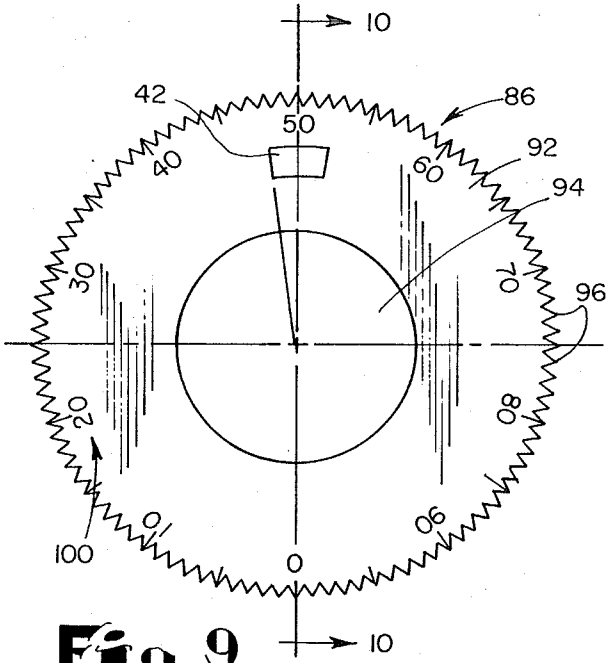
FIG. 9 is an enlarged, front schematic view of an inner wheel element of the tumbler wheel used in one embodiment of the present invention.
Figure 12:
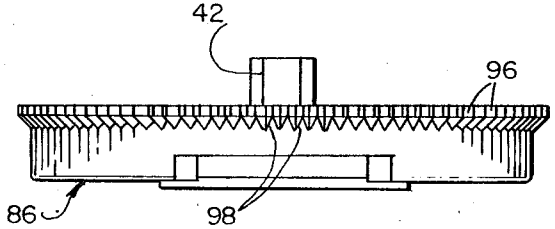
FIG. 12 is a side perspective view of the inner wheel element illustrated in FIG. 9.

Still referring to FIGS. 5 and 6, a plurality of apertures or openings 13B in the form of V-shaped notches are disposed circumferentially about the outer rim 116. The openings or notches 138 are spaced equidistantly, and in preferred form, there is one notch 138 associated with each index mark 110 and 112. As can be seen from FIG. 4, the notches 138 are sized and shaped to permit a pin 140 which is part of the change key assembly 78 to pass there through and lodge therein. The pin 140 is axially aligned parallel to the key 80 of the key assembly 78. The pin 140 passes through a second opening 142 in the rear wall 16 of the lock case 12 when the key assembly 78 is inserted into the lock 10. While only one notch 138 is actually necessary in each tumbler wheel 38, a plurality of notches 140 are preferred for balance and symmetry when rotating the tumbler wheels 38 as well as for radiographic masking purposes. As the key 80 is inserted into the opening 76, the pin 140 passes through the opening 142 and through a notch 138 in each of the tumbler wheels 38. When the key 80 is fully inserted to completely separate each inner wheel 86 from each outer wheel 88 of each tumbler wheel 38, 38' the pin 140 has passed through the notches 138 in each of the outer wheels 88. The pin 140 maintains the outer wheels 88 in position and prevents rotational movement thereof while the inner wheels 86, which have been disengaged from the outer wheels 88, are rotated to change the combination of the lock 10. Preferably, there are approximately 50 notches 138 provided about the circumference of the rim 116 so as to provide for ample number of openings for the pin 140 to maintain the outer wheels 88 in position. It should also be noted that the notches 138 occur throughout the entire rim 116, including the indented portion 124. Thus, masking of the gate 114 against detection through radiographic techniques is further assisted by this arrangement.

Another unique feature of the present invention relating to lock security is the provision of a driver shadow ring 144. Typical combination locks are arranged to have the nose portion 28 of the fence lever 20 ride the circumferential edge of the driver wheel 32. Thus, the gate 146 present in the driver wheel 32 would normally be readily felt through th dial 34 due to such riding action. This "feel" can permit manipulation of the combination lock by an unauthorized individual. When the fence 30 of the fence lever 20 also rides on the tumbler wheels 38, as in the case of some combination locks, the possibility of manual "feel" and lock manipulation is even greater.

In the design of the present invention, the diameter of the driver wheel 32 is preferably sized slightly greater than the diameter of the tumbler wheels 38, 38', so that the fence 30 will not ride on the circumferential edges of the tumbler wheels 38 except when the dial 34 nears the "0" position where the gate 146 in the driver wheel 32 is ready to accept the nose portion 28 of the fence lever 20 due to the pressure exerted by the spring mechanism 24. A ring 144 is provided immediately adjacent the driver wheel 32 between the front wall 14 of the case 12 and the driver wheel 32. The shadow ring 144 is preferably of the same outer diameter as the driver wheel 32 and rides along an annular lip portion 146 of the front face of the driver wheel 32. Likewise, in one embodiment as illustrated in FIG. 17 and discussed in greater detail below, the ring 144 may have a gate in the outer edge thereof similiar in size and shape to the gate 146 of the driver wheel 32.

Referring in particular to FIGS. 1–4, the shadow ring 144 is preferably interconnected with the driver wheel 32 by a tongue and groove arrangement. This tongue and groove arrangement preferably is in the form of a pin or lug 148 extending from either the driver wheel 32 or the shadow ring 144 into a lost motion slot 150 in the opposite face from the pin. In the illustrated embodiment, the pin 148 projects from the forward face of the driver wheel 32 into an annular lost motion slot 150 disposed in the rearward face of the shadow ring 144.

Curved notches 152 and 154 are formed in the circumferential edges of the driver wheel 32 and the shadow ring 144 respectively. The notches 152 and 154 are sized and shaped to receive a roller member 156 therein, as described in greater below. The lost motion slot 150 in the ring 144 may be of any desired annular length and is preferably of sufficient length so that the notch 154 in the shadow ring 144 trails notch 152 of the driver wheel 32 by ten numbers on the dial 34 in either direction of rotation. Thus, the shadow ring 144 masks the notch 152 in the driver wheel 32 and vice versa. When rotation of the dial is reversed, the shadow ring 144 is not driven in the opposite direction until the dial 34 has moved twenty numbers, by which time the notches 152 and 154 are again masking each other. Similarly, the tumbler wheels 38 will not reverse until the dial 34 rotation has been reversed for at least one full revolution (100 numbers).

Figure 15:
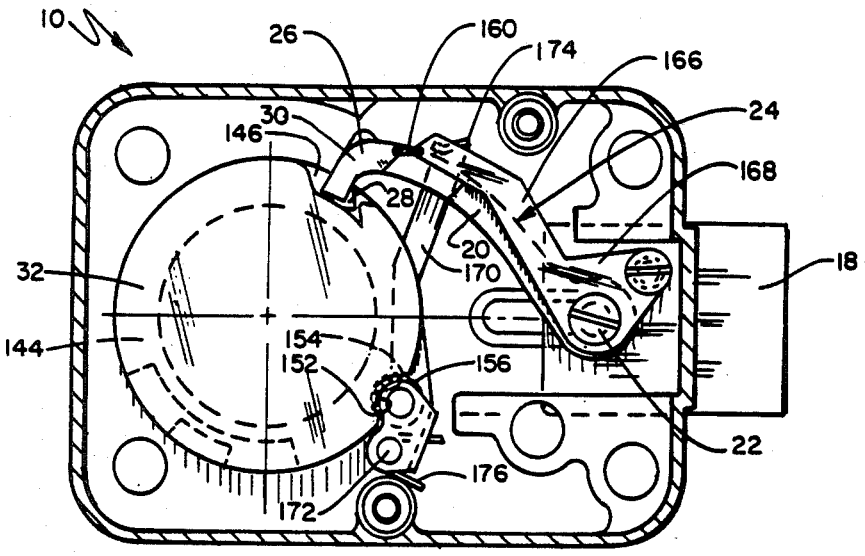
FIG. 15 is a view similar to FIG. 14 but showing the tumbler gates fully aligned and the fence and nose portions of the fence lever fully engaged within their respective gates.

As previously indicated, the fence 30 and nose 28 are generally held away from the driver wheel 32 and tumbler wheels 38 by a spring mechanism 24. In preferred form, the fence lever 20 is pivotally connected by the pin 22 so as to connect the lever 20 for pivotal movement between a raised position as illustrated in FIG. 1, wherein the nose 28 and fence 30 are spaced out of contact with the driver and tumbler wheels, and a lowered position as illustrated in FIG. 15, wherein the nose has engaged the gate 146 and the fence has engaged the aligned gates 114.

Figure 1A:
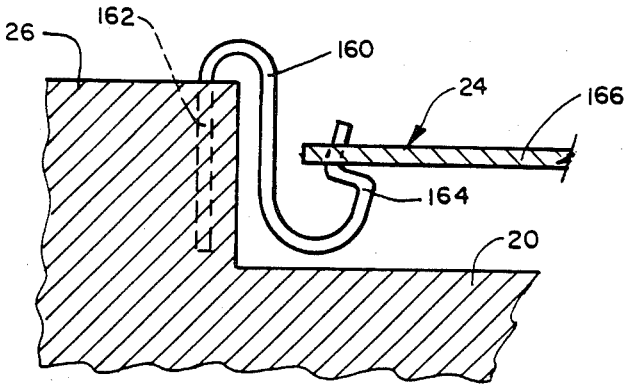
FIG. 1A is an enlarged, partial schematic view, with some parts in section, of the spring biasing mechanism of the present invention as viewed substantially along line 1A—1A of FIG. 1.

Referring particularly to FIGS. 1 and 1A, the spring mechanism 24 includes an off-center spring member 160 in the general shape of an "S". One arm 162 of the spring member 160 is pivotally mounted to the free end 26 of the fence lever 20, and the other arm 164 is connected to the free end of a spring support bracket 166. The opposite end 168 of the bracket 166 is connected by the pin 22. The spring member 160 and support bracket 166 cooperate to normally bias and maintain the free end 26 of the fence lever 20 in its raised position absent any other force exerted against the spring mechanism 24. Thus, mechanical manipulation cannot be used to determine the opening combination of the lock 10 since the fence lever 20 is normally kept away from the wheels 32 and 38.

To move the fence lever 20 to its lowered position, a trip lever 170 is provided. The lever 170 is pivotally mounted near one end by a pivot pin 172 and has a trip arm 174 pivotally movable about the pin 172. The roller member 156 is carried at the opposite end of the lever 170 proximate the pin 172 and is adapted to be received within the notches 152 and 154 when they are aligned together. A spring 176 biases the roller member 156 against the peripheries of the driver wheel 32 and the shadow ring 144, the roller member 156 being sized sufficiently to contact both the wheel 32 and the ring 144.

Figure 13:
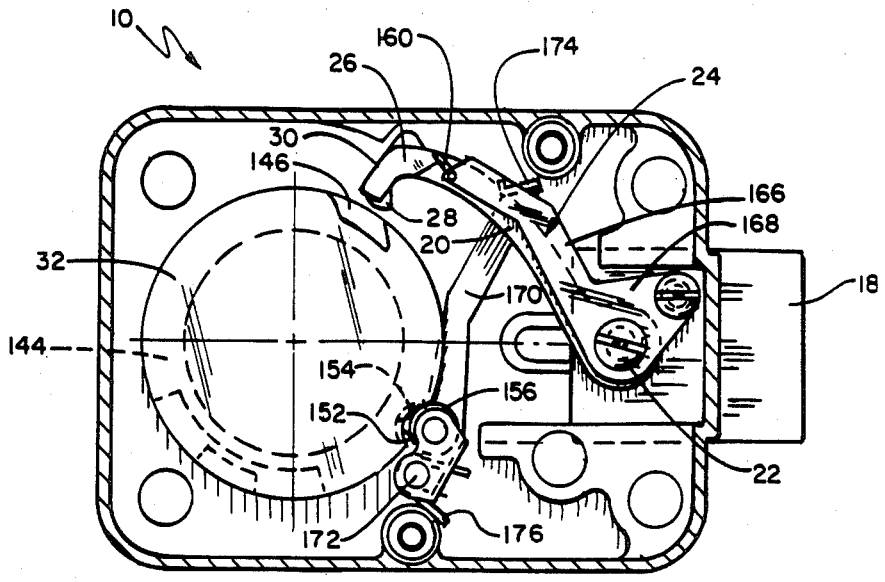
FIG. 13 is a view similar that of FIG. 1 but illustrating the notches of the driver wheel and the shadow ring in alignment and the trip level partially engaging the aligned notch openings.

The fence lever 20 must be moved to its lowered position before the lock 10 may be unlocked. To achieve this with the present invention, the dial 34 must first be turned so as to align the roller notches 152 and 154 as depicted in FIG. 13. At this point, the shadow ring 144 and the driver wheel 32 are aligned with the roller member 156 of the trip lever 170 partially engaging the aligned notches 152 and 154. To achieve contact between the trip arm 174 and the fence lever 20 with sufficient force for lever 20 to move to the position where spring 160 experiences maximum compression and then to move lever 20 slightly beyond so that spring 160 will urge lever 20 into engagement with the tumblers and drive wheel, the roller member must snap freely and completely into the aligned openings 152, 154 as biased by the spring 176.

Figure 14:
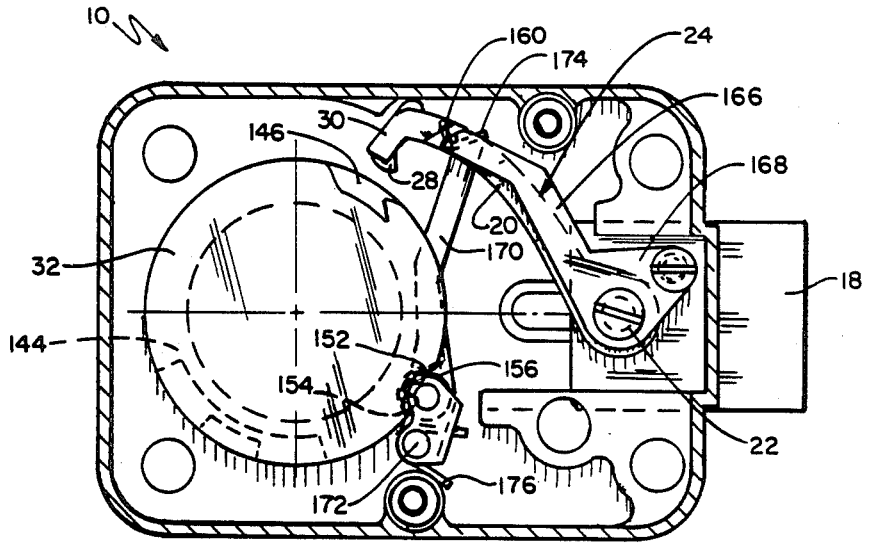
FIG. 14 is a view similar to FIG. 13 with the trip lever fully engaged with the aligned notches and the spring mechanism of the fence lever but with the tumbler gates not aligned.

In FIG. 14, the roller member 156 has engaged the aligned openings 152, 154 and the trip arm 174 of the trip lever 170 has impacted the fence lever 20. However, FIG. 14 depicts the situation where the gates 114 of the tumbler wheels 38 are not aligned. In this instance, the fence 30 contacts the peripheral edge of the tumbler wheels 38. The spring member 160 is sized and shaped so that if the fence lever 20 is not moved sufficiently, as represented by the fence moving into aligned gates 114, the spring 160 does not pass by its center line or position of maximum compression. Consequently, when the fence 30 strikes the periphery of the unaligned tumbler wheels 38, the spring mechanism 24 causes the fence lever 20 to recoil back to its raised position.

Referring to FIGS. 15 and 16, when the trip arm 174 engages the fence lever 20 so that the fence 30 impacts the tumbler wheels 38, and the gates 114 are in alignment, the spring member 160 passes by its position of maximum compression and subsequently biases the nose 28 into the gate 146 of the driver wheel 32 as well as the fence 30 into the aligned gates 114 of the tumbler wheels 38. This spring bias then maintains the fence lever in its lowered position. Once this is achieved, the driver wheel 32 is further rotated to retract the bolt 18 to its unlocked position as illustrated in FIG. 16, the spring member 160 still maintaining the nose 28 and fence 30 in their engaged positions. Counterclockwise rotation of the driver wheel 32 will disengage the various components and return the lock 10 to its normal operating condition as depicted in FIG. 1.

An alternate embodiment of the present invention is illustrated in FIG. 17. In this embodiment, a shadow ring 180 is provided similar to the prior embodiments. However, there is no spring mechanism 24 nor trip lever 170. In this embodiment, the shadow ring 180 includes a gate 182 sized and shaped substantially identical to the gate 146 for receiving the nose 28 of the fence lever 20. The shadow ring 180 is connected to the driver wheel 32 in a manner similar to that of the previous embodiment. In this instance, however, the nose 28 normally rides on the periphery of the driver wheel 32 and the shadow ring 180. Due to the lost motion coupling between the shadow ring 180 and the driver wheel 32, the gate 182 of the shadow ring 180 trails the gate 146 in either direction of rotation similar to the notches 152 and 154 of the prior embodiments. Thus, the shadow ring masks the gate 146. Therefore, this arrangement makes it impossible for the fence 30 to contact the tumbler wheels 38 while they are in motion since the depending nose 28 cannot engage either gate 146 or gate 182 separately and cannot engage them together until rotation of the tumbler wheels 38 has been stopped and the gates 114 thereof aligned for opening of the lock 10.

When operating the know combination locks, after dialing the combination in the customary manner, the dial is generally returned to the "0" position for the fence lever to engage the driver wheel. At this point, most locks differ slightly in the way that the fence lever is allowed to engage the driver wheel. One known lock requires that the spindle 82 of the driver wheel 34 be pushed in to release the fence lever. Another known combination lock requires that the dial 34 be held from rotating with one hand while an interspline lever is turned with the other hand.

The embodiment of the present invention, with the shadow ring 144 and 180 designs, requires that the operator of the combination lock 10 rotate the dial 34 past the "0" position by ten numbers to the "90" position and reverse back to "0". This is due to the shadow ring design and the lost motion slot 150. If the lost motion slot 150 is of sufficient length for fifteen numbers, then dial 34 must be moved past the "0" position by fifteen numbers. This procedure, while different from other locks, is not any more cumbersome to operate yet provides complete masking of the driver wheel gate while simultaneously prevents the fence lever 20 from riding on the circumferential edges of the tumbler wheels 38 while they are in rotation regardless of the position of the driver wheel gate.

Figure 18:
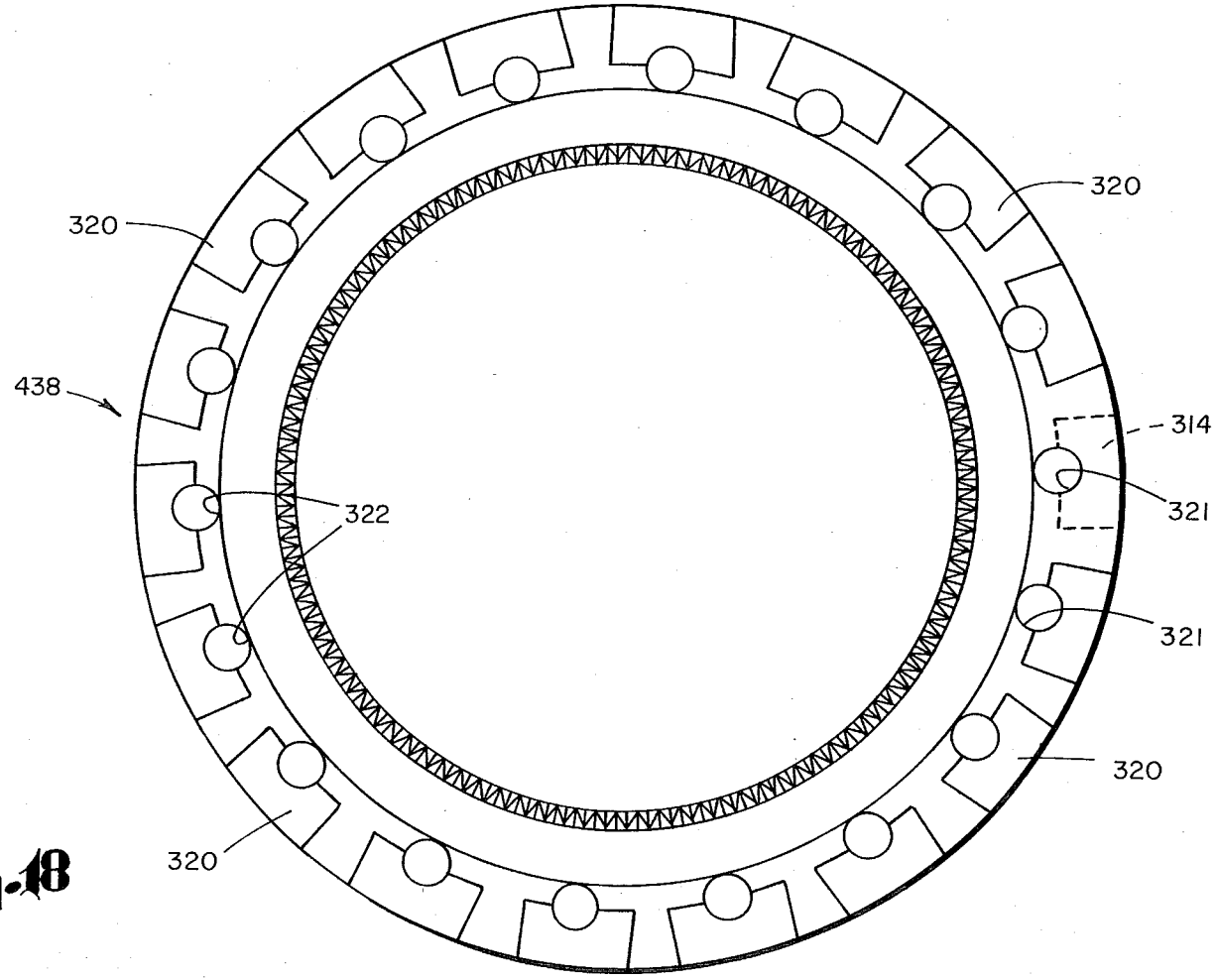
FIG. 18 is a view like FIG. 5 showing an alternate embodiment of an outer tumbler wheel.

Refer now to FIG. 18 there being shown an alternate embodiment of an outer tumbler wheel generally designated by reference numeral 438. Wheel 438 has an number of false gates 320 distributed about its periphery opening to one side. The true gate 314 opens to the opposite side. A key hole 322 is provided through each gate location.

Figure 19:
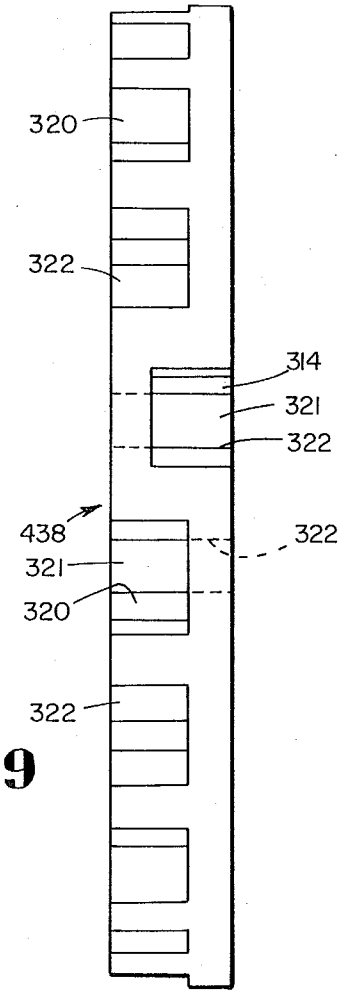
FIG. 19 is a side view of the outer tumbler wheel of FIG. 18.

Refer now to FIG. 19 wherein a side view of tumbler wheel 438 is shown. Note again that all of the false gates 320 open to one side of wheel 438 and the true gate 314 opens to the other side. Key holes 322 are shown, by phantom lines, extending all the way through the thickness of wheel 438 only in two instances for clarity of the drawing. However, all of the holes 322 extend through the entire thickness of wheel 438. Each of holes 322 has a trough portion 321 in the open area of its respective gate.

Holes 322 function to accept a locking pin when changing the combination by a key method similar to the way pin 140 locks outer tumbler wheels 38 as described above with reference to FIG. 4.

The gate of the outer tumbler wheel of the embodiment of FIGS. 18 and 19, may be visible when viewed by x-ray apparatus. However, one of the gates is the true gate 314, the rest being false gates. It is not detectable by such x-ray which of the gates is the true gate. However, given the number of tumblers, usually three, a finite number of combinations are possible. This number of combinations is large but is significantly less than the combinations of the outer tumbler wheel illustrated in FIG. 5. Thus, the outer tumbler wheel embodiment of FIGS. 18 and 19 provide a high degree of security but not as high as the embodiment of FIG. 5. However, tumbler wheel 438 is sturdier in some respects and may be preferable in high durability applications.

Figure 20:
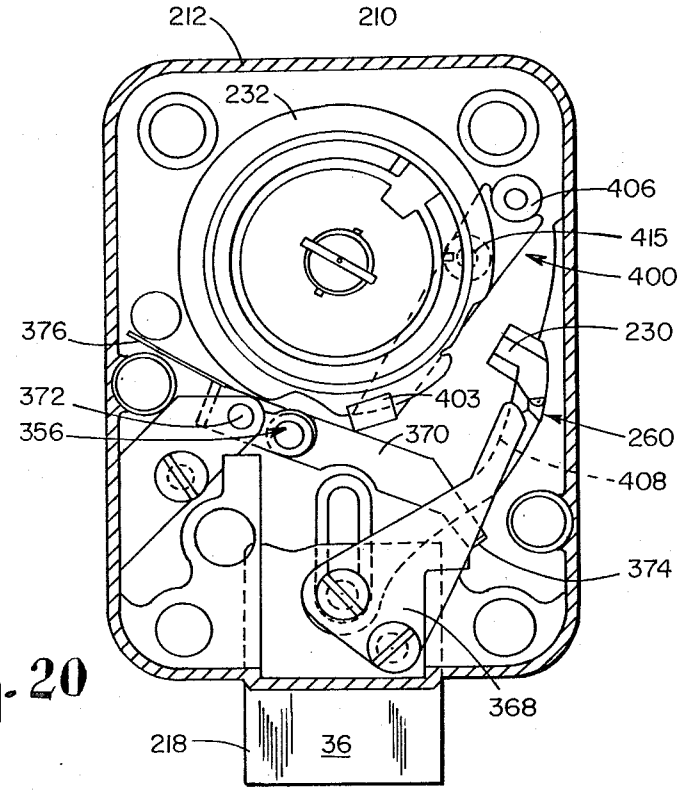
FIG. 20 is a front view of another embodiment of a combination lock with the front wall of the lock case removed therefrom.

Refer now to FIG. 20 there being shown a view of another alternate embodiment of the present invention with the rear cover removed. This embodiment of the combination lock mechanism of the invention is similar to the embodiment illustrated in FIG. 1 with the below described exceptions.

Figure 22:
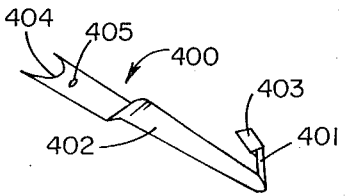
FIG. 22 is a perspective view of the trip spring of FIG. 21.

In the embodiment of FIG. 20, generally designated by reference numeral 210, trip arm 374 is held in the position shown by interference with trip spring 400. Trip spring 400 is secured to the case 212 by screw 415 through hole 405 and is held from rotation about screw 415 by the mating of recess 404 with pin 406. Trip spring 400, which is shown in perspective in FIG. 22, includes a first leg portion 402, a second leg portion 401 and a foot portion 403. Leg portion 402 extends between drive wheel 232 and the front 214 of casing 212. Leg portion 401 extends up the side of drive wheel 232 and foot portion 403 extends towards the center and engages the back surface of wheel 232. Thus, upon axial translation of wheel 232 from the front towards the back, foot 403 is engaged by wheel 232 and leg portion 402 is raised a sufficient amount to allow trip lever 370 to snap against fence lever 220. Trip arm 174 impacts trip lever 220 near edge 408 and fence lever 220 is pushed down in contact with tumbler wheels 238 and 239 as well as drive wheel 232. If the gates are appropriately aligned to accept fence portion 230 and fence portion 229 and nose 228 then the fence lever will continue to travel and nose 228 will engage drive wheel 232. If however, there is not the correct alignment of the gates, fence lever 220 will impact onto the edge of the wheels and spring 360 will not have been compressed to its maximum extent and will force fence lever 220 back towards 212. Trip arm 374, however, will continue to move through slot 409 formed in the side of fence lever 220. Subsequent rotation of the drive wheel 232 acting against idle wheel 356 will cause trip lever 370 to be forced back and pivot about pin 372 against the bias of spring 376. Once the trip lever 370 is pushed back sufficiently, trip spring 400 will return to its position in interference with trip lever 370, thus holding it in a cocked position.

Note that the contour of fence portion 230 as well as, nose 228 mates with the gate areas when they are in proper alignment. This contouring of the fence portions 230 and 228 increases the reliability and durability of the mechanism.

Figure 21:
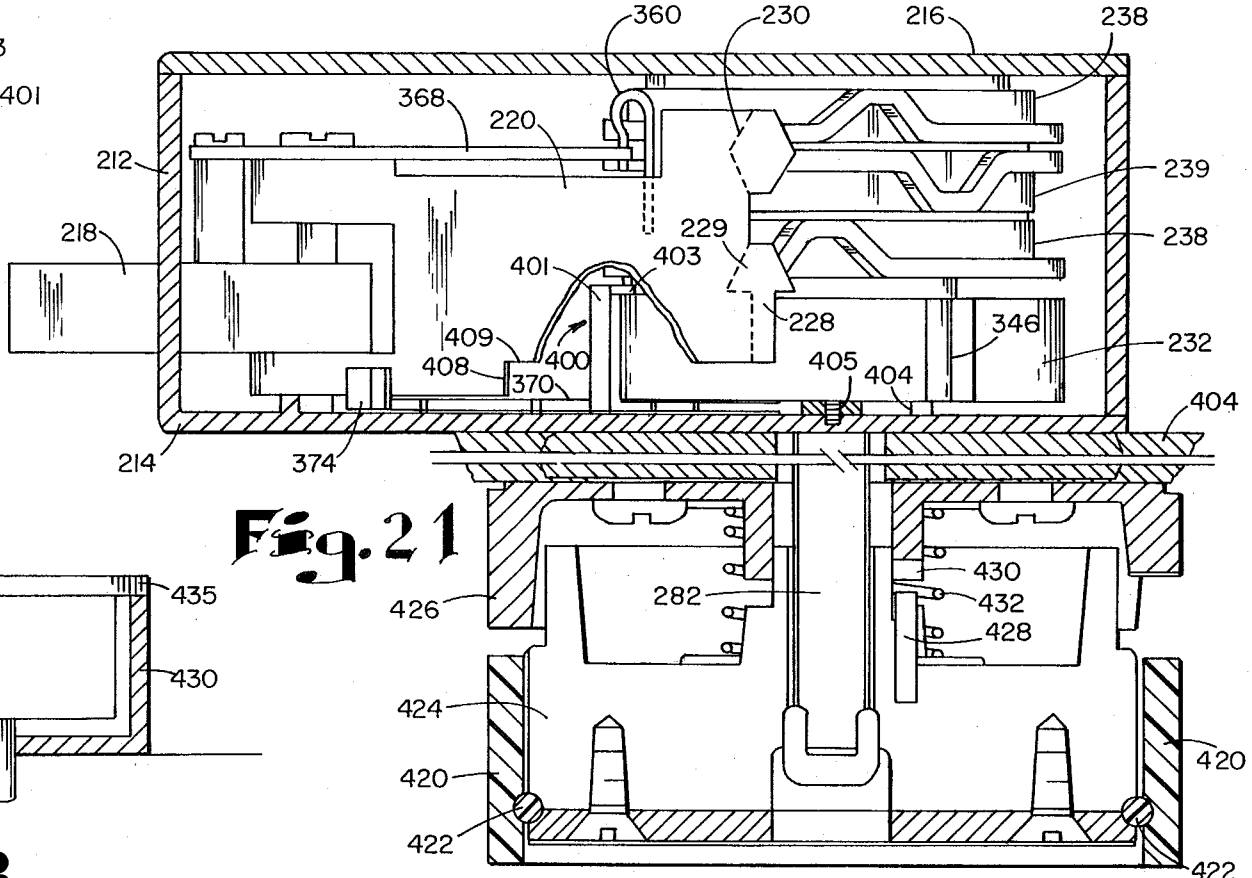
FIG. 21 is a partial cut away side view of the embodiment of FIG. 20.

Locking mechanism 210 is illustrated in FIG. 21, mounted on vault 440 as part of the security system according to the present invention. Dial plate 426 is also mounted to vault 440 and shaft 282 of dial 424 extends through plate 426 and vault 440 to engage drive wheel 232. Dial 424 is mounted to compress spring 432 to move drive wheel 232 as described above. Dial 424 can only be moved when pin 428 is aligned with slot 430. This will occur at some set number on the dial face such as 0. Surrounding dial 424 is rubber O-ring 422. Rubber grip 420 is cylindrical and surrounds dial 424 and engages O-ring 422. O-ring 422 functions to keep grip 420 in position around dial 424. In order to turn dial 424 it is necessary to compress the elastomeric grip 420. If grip 420 is not compressed from the sides, then dial 424 will not turn. As a result of this arrangement, finger marks do not build up on the dial surface or structure surrounding the dial which may be used as an indication of the combination of the lock mechanism.

Figure 23:
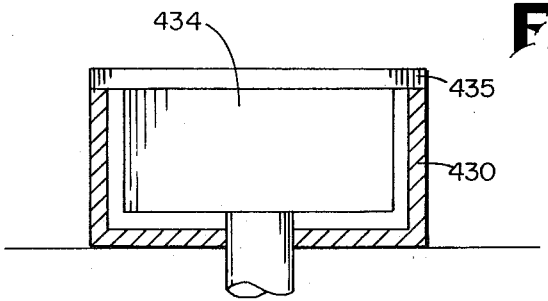
FIG. 23 illustrates an alternate embodiment of a dial construction.

Refer now to FIG. 23 wherein another lock mechanism is shown which also decreases the possibility of finger marks as described above. In this arrangement, dial 434 has a flange portion 435 which has substantially the same outer diameter as cup 430. Cup 430 is freely moving and may be conveniently grasp when turning dial 434. With the arrangement of FIG. 23 utilizing the freely rotating fourth cup 430 finger marks will not build up in certain positions so as to reveal the relative locations of the combination of the locking mechanism.

As can be seen from the above, the combination lock of the present invention has a number of advantages and improvements over presently existing combination lock designs. The dial combination of the lock of the present invention may be changed either through the use of a special key assembly wherein a new combination may be readily dialed in by an untrained individual, or it may be changed by hand. However, the process by which the combination may be changed by hand is so simple so as not to require the services of a locksmith. The combination lock of the present invention also provides improved security measures by including a gate masking mechanism whereby the gates in the tumbler wheels may not be seen through radiographic techniques nor felt by manipulation of the lock 10. Finally, the combination lock of the present invention also prevents the radiographic examination of the driver wheel gate as well as the manipulation of the combination lock dial so as to be able to "feel" the driver wheel gate.

It will be understood that is invention may be embodied in other specific forms without departing form the spirit or central characteristics thereof. The present examples and embodiments, therefore, are to be considered in all respects as illustrative and not restrictive, and the invention is not to be limited to the details given herein but may be modified within the scope of the appended claims.

What is claimed as new and desired to be secured by Letters Patent of the United States is:

1. A tumbler arrangement for a combination lock adapted for having its combination changed either by hand or with the use of a key, said tumbler arrangement comprising:

means for mounting a plurality of tumbler wheels in a stacked relationship for rotation about an axis, each of said tumbler wheels having an inner element releasably engaged with a circumferentially disposed outer element, with each said outer element having a peripheral gate and means for masking said gate;

means for maintaining said inner and outer elements in an engaged condition for simultaneous rotation under normal tumbler operation;

a peripherally gated rotatable driver wheel for rotating said tumbler wheels;

a fence lever having a nose for contact with said driver wheel and a fence for contact with said tumbler wheel;

means for preventing contact by said fence with the circumferential edges of said tumbler wheels while said tumbler wheels are being rotated;

means for axially disengaging said stacked inner elements from said stacked outer elements by said key while simultaneously preventing rotational and axial movement of said out element as the disengaged inner elements are rotated to change the combination of said tumbler arrangement said axially disengaging means further includes each said outer element having an opening formed therein for receiving a pin member operable in parallel with said key, said pin member passing through the opening in each said outer element to thereby prevent rotation of said outer elements as said inner elements are disengaged therefrom by said key;

each said outer element including a plurality of said openings which include holes formed through the thickness of said outer element and disposed radially equidistantly about the rotational axis of said outer element for symmetry and balance.

2. The tumbler arrangement as claimed in claim 1, wherein said inner and outer elements comprise wheels each having a plurality of teeth disposed thereon, said teeth being adapted to intermesh with each other to interconnect each inner element with its corresponding outer element.

3. The tumbler arrangement as claimed in claim 2, wherein the teeth of each said tumbler wheel are adapted for disengagement when the inner element of said tumbler wheel is moved in an axial direction.

4. The tumbler arrangement as claimed in claim 1, wherein said mounting means comprises an axially extending and movable tumbler post about which said tumbler wheels are mounted for rotation, said inner elements being retained on said post for axial movement therewith.

5. The tumbler arrangement as claimed in claim 4, wherein said mounting means further includes an axially extending stud adapted to received said tumbler post thereon in a sleeve-like manner, said tumbler post being mounted on said stud for axial movement thereon.

6. The tumbler arrangement as claimed in claim 5, wherein said means for axially disengaging said stacked inner elements from said stacked outer elements by said key includes a catch member attached to said tumbler post and adapted for engagement with said key to move said tumbler post axially along said stud in response to engagement and movement by said key.

7. The tumbler arrangement as claimed in claim 6, wherein said disengaging means further includes a spring member for maintaining said inner elements and outer elements in a normally engaged condition and adapted for compression when said catch member and tumbler post are moved axially by said key.

8. The tumbler arrangement as claimed in claim 6, wherein said catch member comprises an arm projecting through said tumbler post and said stud substantially perpendicular to the axis thereof and attached to said post for movement therewith, said stud including a pair of axially oriented, oppositely disposed slots in the sides thereof through which said arm projects to permit movement of said arm axially relative to said stud, said slots acting as a stop to the axial movement of said tumbler post in response to engagement and movement by said key.

9. The tumbler arrangement as claimed in claim 1, wherein said axially disengaging means further includes each said outer element having an opening formed therein for receiving a pin member operable in parallel with said key, said pin member passing through the opening in each said outer element to thereby prevent rotation of said outer elements as said inner elements are disengaged therefrom by said key.

10. The tumbler arrangement as claimed in claim 9, wherein each said outer element includes a plurality of said openings which comprise notches disposed equidistantly and circumferentially about the periphery of said outer element for symmetry and balance.

11. The tumbler arrangement as claimed in claim 10, wherein said outer element includes at least 50 of said notches.

12. The tumbler arrangement as claimed in claim 1, wherein each said outer element includes an outer peripheral rim circumferentially disposed there about, and wherein said masking means comprises an axial indentation disposed in said rim forming said peripheral gate, the thickness of the rim portion forming said indentation being adapted to provide a uniform axial cross-sectional thickness throughout said entire rim resulting in a uniform axial radiograph of said rim.

13. The tumbler arrangement as claimed in claim 12, wherein said rim is aligned proximate one face of said outer element and said axial indentation is axially displaced toward the opposite face of said element.

14. The tumbler arrangement as claimed in claim 12, wherein the sides of said indentation are sloped and reduced in actual thickness to provide as uniform axial cross-section substantially identical to the rest of said rim.

15. The tumbler arrangement as claimed in claim 1, wherein said contact prevention means comprises said driver wheel having a diameter sufficient to maintain said fence away from the circumferential edge of said tumbler wheels except when said fence lever nose approaches the gate disposed in said driver wheel, a driver shadow ring disposed adjacent said driver wheel and having a diameter substantially the same as said driver wheel, said shadow ring having a gate disposed in the circumferential edge thereof such that said nose must engage both said driver wheel and shadow ring gates simultaneously to permit said fence to engage said tumbler wheel gates, and means for interconnecting said shadow ring and said driver wheel to permit the gate in said shadow ring to trail the gate in said driver wheel a predetermined angular distance in either direction of rotation to mask the gate of said driver wheel and prevent said fence lever nose from prematurely engating the driver wheel gate to contact said fence with said tumbler wheels while said tumbler wheels are in rotation.

16. The tumbler arrangement as claimed in claim 15, wherein said tumbler wheels are interconnected such that said tumbler wheels will not reverse direction of rotation until said driver wheel has been reversed at least one full revolution in either direction.

17. The tumbler arrangement as claimed in claim 15, wherein said means for interconnecting said shadow ring and said driver wheel comprises a tongue and groove arrangement wherein said groove is of sufficient angular length to provide a predetermined lost motion movement between said shadow ring and said driver wheel.

18. The tumbler arrangement as claimed in claim 17, wherein said tongue comprises a pin projecting from the face of said shadow rings and said groove is the form of a lost motion slot formed in the surface of said driver wheel immediately opposite said pin whereby said lost motion is provided by movement of said pin within said slot.

19. The tumbler arrangement as claimed in claim 1, wherein said fence lever is pivotally connected for movement between a raised position spacing said fence and nose out of contact with said tumbler and driver wheels and a lowered position wherein said fence and nose are engaged within said gates, and wherein said contact prevention means comprises off-center spacing means normally biasing said fence lever to said raised position and adapted for movement past center to bias said nose and fence within said gates when said gates are in an aligned position, a driver shadow ring disposed adjacent said driver wheel and having a diameter substantially the same as said driver wheel, said driver wheel and said shadow ring each having a roller notch disposed in the peripheral edge thereof, and a trip lever having means for seating within said notches when said notches are aligned to engage said trip lever against said fence lever to move said fence lever toward its lowered position.

20. The tumbler arrangement as claimed in claim 19, wherein said trip lever comprises roller means disposed at one end thereof biased for rolling contact against said driver wheel and shadow ring and adapted for seating within said roller notches when said notches are aligned, and engagement means disposed at the opposite end of said trip lever and adapted to impact said fence lever and pull it toward said lowered position when said roller means becomes seated within said aligned notches.

21. The tumbler arrangement as claimed in claim 20, wherein said engagement means is adapted to pull said fence lever into said lowered position when said gates are fully aligned, said spring means returning said fence lever into said raised position when said fence and nose engage said wheels and said gates are not aligned.

22. The tumbler arrangement as claimed in claim 19, wherein said off-center spring means comprises a spring support bracket spaced from said fence lever and an off-center spring member interconnecting the end of said bracket and the free end of said fence lever, said spring member being sized and shaped to normally bias said fence lever in said raised position and to bias and maintain said fence lever in said lowered position when said gates are in an aligned condition and said trip lever has moved said fence lever and spring member past center.

23. A security system comprising:

enclosure means for holding an object there within securely against access from outside said enclosure means;

access means for selectively permitting access to said enclosure means; and combination locking means for locking said access means to prohibit access to said enclosure means and including means for mounting a plurality of tumbler wheels in a stacked relationship for rotation about an axis, each of said wheels having a peripheral gate and means for masking said gate, said combination lock means further including a dial means for rotating said tumbler wheels without leaving finger prints as an indication of the combination, said dial means including a cylindrical dial and a cylindrical elastomeric grip positioned to surround the dial and sized so that it must be gripped and compressed to turn the dial.

24. A security system as in claim 1, wherein each of said tumbler wheels includes an outer peripheral rim circumferentially disposed thereabout and wherein said masking means comprises an axial indentation disposed in said rim forming said peripheral gate, the thickness of the rim portion forming said indentation being adapted to provide a uniform axial cross-sectional thickness throughout said entire rim resulting in the uniform axial radiograph of said rim.

25. A security system as in claim 24, wherein the sides of said indentation are sloped and reduced in actual thickness to provide a uniformed axially cross-section substantially identical to the rest of said rim.

26. A system as in claim 25, wherein said enclosure means is a file cabinet and said access means is the file cabinet door.

27. A system as in claim 25, wherein said enclosure means is a vault and said access means is the vault door.

28. A system as in claim 27, wherein said vault is a room and said access means is sized to allow human access.

* * * * *